United States Patent [19]

Acosta

[11] Patent Number: 4,733,754

[45] Date of Patent: Mar. 29, 1988

[54] DRIVE-IN SERVICE ESTABLISHMENT

[76] Inventor: Richard Acosta, 6214 Madeleine, San Antonio, Tex. 78229

[21] Appl. No.: 730,675

[22] Filed: May 3, 1985

[51] Int. Cl.[4] ..... E04H 3/04

[52] U.S. Cl. ..... 186/53; 186/41

[58] Field of Search ..... 186/35–38, 186/41, 52, 53, 60; 52/174, 33, 169.2, 169.3, 175, 176, 234

[56] References Cited

U.S. PATENT DOCUMENTS

| | | | |
|---|---|---|---|
| 2,638,636 | 5/1953 | Pool | 186/53 X |
| 3,763,963 | 10/1973 | Wisznia | 186/37 |
| 3,774,723 | 11/1973 | Johnston | 186/36 |
| 4,154,027 | 5/1979 | Searcy | 186/52 X |
| 4,245,720 | 1/1981 | Neill, Jr. | 186/38 |

*Primary Examiner*—Joseph J. Rolla
*Assistant Examiner*—Kevin P. Shaver

[57] ABSTRACT

Disclosed is an establishment designed to facilitate dispensing food or other commodities to customers in automobiles from drive-up stations or windows. The establishment has two of its sides joined in a curved segment with one dispensing window on the curved segment, and dispensing windows on adjacent sides. Multiple egress lanes are disposed such that at least one lane is accessable from each dispensing window even while automobiles are parked at the other windows. The use of a curved segment rather than the typical corner arrangement facilitates using multiple egress lanes to significantly increase traffic flow.

2 Claims, 1 Drawing Figure

DRIVE-IN SERVICE ESTABLISHMENT

BACKGROUND OF THE INVENTION

The present invention pertains to establishments catering to drive-up, automobile service, such as restaurants that dispense food through drive-up windows.

Many restaurants provide drive-in service. Typically, an establishment provides one or more dispensing windows and an order taking station. A single traffic lane is provided past the order station and the dispensing window(s), such that automobiles drive up, place their orders at the order station and pick up their order at a dispensing window.

This typical arrangement inevitably creates traffic bottlenecks in moving cars from the order station past the dispensing window(s), particularly when a large order has to be filled.

Some drive-up service establishments increase traffic flow by providing multiple ingress/egress lanes, with a dispensing station associated with each lane, as is typically the case with drive-in bank teller operations. To accommodate remote dispensing stations, a pneumatic or other document transfer system is provided between a main building and each remote teller station. An example of such a system in the food industry is U.S. Pat. No. 4,311,211 to Benjamin et al, which discloses a packaged food delivery system having multiple ingress and egress lanes with remote dispensing stations; packaged food is transported from a central building to remote dispensing stations using an overhead electrically driven carrier for transporting a gimballed tray carrying money and food stuffs.

The use of mulutiple remote dispensing stations is disadvantageous in several respects for restaurants and other such establishments. First of all, they are not cost effective in their use of land. Second, their order delivery systems are expensive and unsuited to transporting restaurant food orders.

SUMMARY AND OBJECTS OF THE INVENTION

Objects. To provide advantages over prior art service establishments catering to drive-in food or other commodity dispensing, the objects of the present invention are:

1. To provide an establishment that facilitates dispensing food or other commodities to customers in automobiles from drive-up dispensing stations.

2. To provide such an establishment designed such that multiple egress lanes can be arranged to facilitate independent egress from any of multiple dispensing windows so as to significantly reduce traffic bottlenecks, thereby increasing traffic flow and dollar volume through faster service.

Summary. Briefly, these and other objects that will be apparent to those of ordinary skill in the art are accomplished by a drive-up service establishment having two sides joined in a curved segment. One dispensing station is located on the curved segment, and an additional dispensing station is located on one or both of the adjacent sides. Multiple egress lanes are arranged such that automobiles may egress from any dispensing station even though automobiles are parked at the other dispensing stations. Providing a curved segment, with a dispensing station located on the curved segment, greatly facilitates the use of multiple egress lanes such that order dispensing and traffic flow is greatly facilitated, thereby increasing sales volume.

BRIEF DESCRIPTION OF THE DRAWING

A more complete understanding of the present invention can be had by reference to the following detailed description of a preferred embodiment when considered in conjunction with the accompanying drawing in which:

The FIGURE shows an overhead plan view of the drive-up service establishment with a dispensing station located on a curved segment and multiple egress lanes.

DESCRIPTION OF A PREFERRED EMBODIMENT

Figure 1:
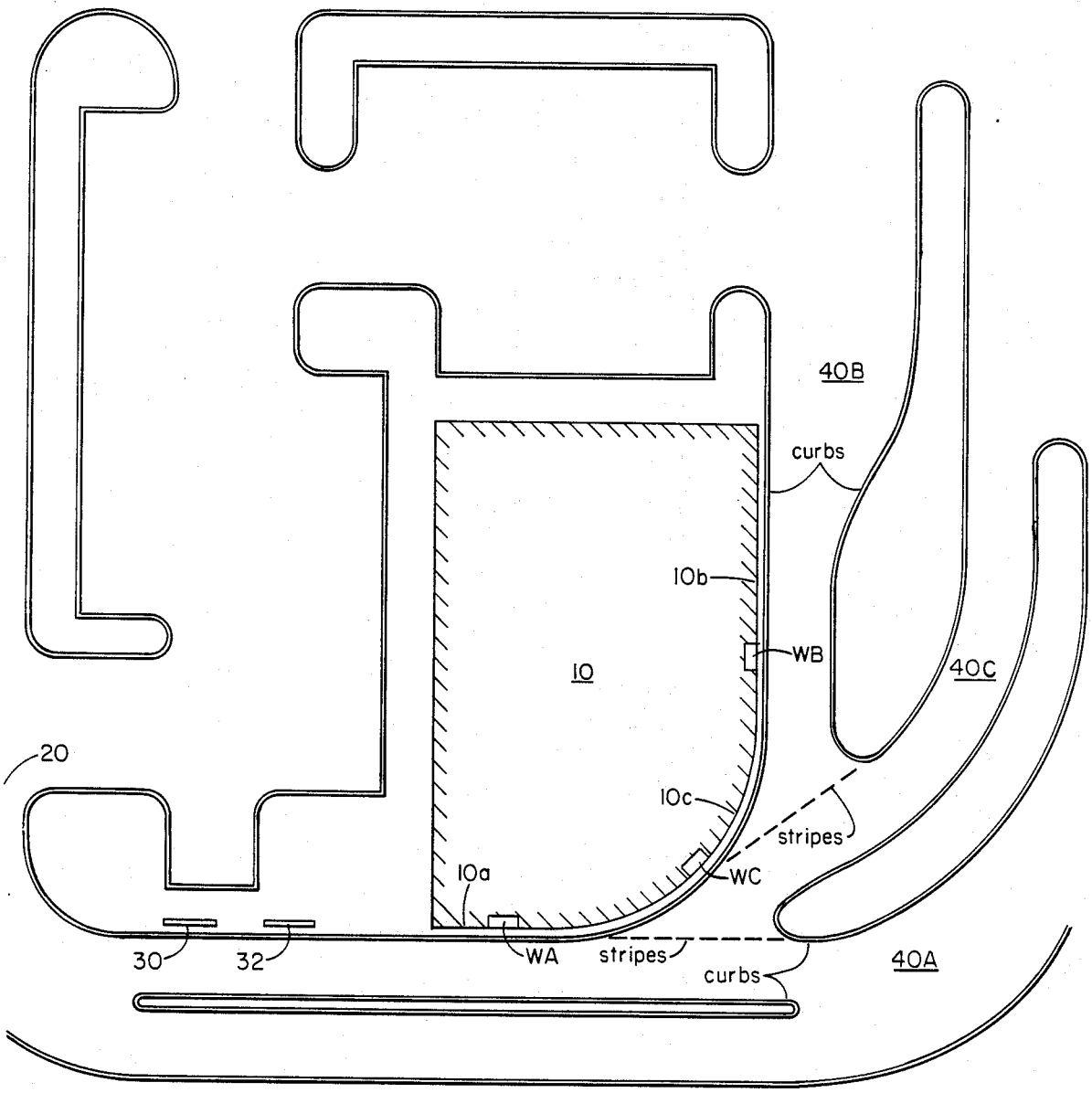

The preferred embodiment will be described in connection with a restaurant service establishment that provides drive-up order dispensing through multiple windows typically staffed by restaurant personnel. Of course, other arrangements could be used to actually dispense food or other commodities.

The figure shows a service establishment 10 that includes side walls 10A and 10B joined by a curved wall segment 10C. Multiple dispensing stations (in this case windows) are provided, with a window WA located on side 10A, a window WB located on side 10B, and a window WC located approximately medial the curved segment 10C. Each window is adapted for dispensing food orders to automobiles that park adjacent the windows.

A single ingress lane 20 is provided by which automobiles can obtain drive-up service by placing an order at a menu/order station 30. The orders are then picked up at one of the three dispensing windows WA, WB or WC. A second menu/order station 32 permits two orders to be taken at a time.

After receiving an order at one of the dispensing windows, an automobile exits the service establishment through one of egress lanes 40A, 40B or 40C. Egress lane 40A is accessible to automobiles exiting window WA even though an automobile may be parked at window WC. Egress lane 40C is accessible to an automobile exiting window WC even though an automobile is parked at window WB. Egress lane 40B is accessible to automobiles exiting window WB.

In operation, automobiles placing orders at the menu-/order stations 30/32 can drive ahead to either dispensing windows WA, WB or WC. Once an order is filled and paid for, the automobile exits the service establishment via its assigned egress lane 40A, 40B or 40C, unaffected by other automobiles parked at the other dispensing windows.

Providing a dispensing window WC on curved segment 10C is an important aspect of the invention, as are the arrangement of the multiple egress lanes. This arrangement represents a significant improvement over current building designs for service establishments in terms of smooth traffic flow and the ability to provide multiple egress lanes.

Another significant advantage of the present design for a service establishment is its flexibiity in providing improved traffic flow. For example, window WB can be reserved for large orders, with windows WA and WC being used for smaller orders that can be filled more quickly. In that regard, window WB can be located such that a second automobile can stop behind the automobile at window WB without constricting exit from window WC via egress lane 40C.

The present invention has been described in relation to a preferred service establishment catering to drive-up service. Designing the service establishment to include a curved segment 10C facilitates the use of multiple dispensing windows and egress lanes for improved traffic flow.

While the invention has therefore been described with respect to a preferred embodiment, it is to be clearly understood by those of ordinary skill in the art that the invention is not so limited, but rather that the limits of the invention are to be interpreted only in conjunction with the appended claims. For example, additional dispensing windows can be provided, or one dispensing window can be eliminated (or closed down). If only two dispensing windows are used, eliminating window WA will also eliminate the need for egress lane 40A, thereby conserving space.

The embodiments of the invention in which an exclusive property privilege is claimed are as follows:

1. A service establishment for dispensing food or other commodities to customers in automobiles comprising:

(a) a building having first and second nonparallel walls joined together by a curved wall;

(b) a central dispensing station for dispensing commodities located approximately medial said curved wall;

(c) a first dispensing station located on said first wall;

(d) an automobile ingress lane by which all automobiles can access either said first or central dispensing stations, said ingress lane having a width which will accommodate only a single automobile at a time.

(e) first and central egress lanes, said first egress lane being parallel to said first wall and accessible from said first dispensing station, and said central egress lane being generally tangential, at least initially, to a portion of said curved wall and accessible from at least said central dispensing station, said egress lanes having a width which will accommodate only a single automobile at a time, said curved wall having an area immediately adjacent thereto at said central dispensing station for accommodating a single automobile to receive commodities from said central dispensing station, said area being disposed out of the path of said first egress lane, whereby, automobiles at either said first or central dispensing stations may egress via their respective egress lanes by proceeding in a substantially straight-forward direction even though an automobile is parked at the other dispensing station, thereby facilitating traffic flow through the service establishment.

2. The service establishment defined in claim 1 further including:

(a) a second dispensing station located on the second wall of said building;

(b) a second egress lane accessible from said second dispensing station, said second egress lane having a width which will accommodate only a single automobile at a time, whereby an automobile at said second dispensing station may egress via said second egress lane by proceeding in a substantially straight-forwardly direction even though automobiles are parked at the other dispensing stations.

* * * * *